US012209497B2

(12) United States Patent
Fiander et al.

(10) Patent No.: US 12,209,497 B2
(45) Date of Patent: Jan. 28, 2025

(54) ROTARY CASING DRILL

(71) Applicant: ATLAS MANUFACTURING LTD., Merville (CA)

(72) Inventors: David Fiander, Merville (CA); Patrick Glover, Merville (CA); Kenneth Anderson, Merville (CA)

(73) Assignee: ATLAS MANUFACTURING LTD., Merville, CA (US)

( * ) Notice: Subject to any disclaimer, the term of this patent is extended or adjusted under 35 U.S.C. 154(b) by 0 days.

(21) Appl. No.: 18/139,208

(22) Filed: Apr. 25, 2023

(65) Prior Publication Data

US 2023/0340837 A1 Oct. 26, 2023

Related U.S. Application Data

(60) Provisional application No. 63/335,017, filed on Apr. 26, 2022.

(51) Int. Cl.
*E21B 7/20* (2006.01)
*E21B 3/02* (2006.01)

(52) U.S. Cl.
CPC ..... *E21B 7/20* (2013.01); *E21B 3/022* (2020.05)

(58) Field of Classification Search
CPC ..... E21B 7/20; E21B 3/00; E21B 3/02; E21B 3/04
See application file for complete search history.

(56) References Cited

U.S. PATENT DOCUMENTS 5,566,769 A * 10/1996 Stuart ..... E21B 19/164 173/149
6,223,629 B1 * 5/2001 Bangert ..... E21B 19/164 81/57.33

(Continued)

FOREIGN PATENT DOCUMENTS

CA 2268579 10/2000

*Primary Examiner* — David Carroll
(74) *Attorney, Agent, or Firm* — Barnes & Thornburg LLP; Mark J. Nahnsen

(57) ABSTRACT

A rotary casing drill for gripping and rotating a tubular structure such as a well casing. The drill includes a housing having at least one gear positioned within the housing. The drill also includes a grip assembly that is driven by the gear. The grip assembly is configured to grip the tubular structure to allow the tubular structure to be rotated about an axis. The grip assembly including a plurality of grippers that are configured to grip the tubular structure to allow it to be rotated. The grippers are positioned radially outwardly from the tubular structure and are adapted to move in a radial direction toward and away from the tubular structure. The grip assembly also includes a compression ring that is positioned radially outwardly from the grippers and is configured to move in an axial direction from a first position to a second position. Axial movement of the compression ring causes radial movement of the grippers. The grip assembly further includes a push-pull member configured to axially move the compression ring and at least one biasing member that is configured to bias one or more of the grippers radially outwardly away from the tubular structure when the compression ring is moved axially away from the grippers by the push-pull member. When the compression ring is in the second position, the push-pull member is permitted to float with respect to the compressing ring.

20 Claims, 8 Drawing Sheets

(56) References Cited

U.S. PATENT DOCUMENTS

| | | | | |
|---|---|---|---|---|
| 2004/0251050 | A1* | 12/2004 | Shahin | E21B 19/161<br>166/380 |
| 2004/0251055 | A1* | 12/2004 | Shahin | E21B 7/20<br>175/423 |
| 2013/0220637 | A1* | 8/2013 | Fabela | E21B 31/18<br>166/382 |
| 2016/0161023 | A1* | 6/2016 | Wentworth | E21B 19/083<br>405/184 |
| 2016/0168928 | A1* | 6/2016 | Magnuson | E21B 19/10<br>166/244.1 |

* cited by examiner

ROTARY CASING DRILL

PRIORITY CLAIM

This application claims priority under 35 U.S.C. § 119(e) to U.S. Provisional Application Ser. No. 63/335,017, filed Apr. 26, 2022, which is expressly incorporated herein by reference in its entirety.

FIELD OF THE INVENTION

The invention is related to apparatus for the continuous drilling of a wellbore through an earth formation.

BACKGROUND OF THE INVENTION

In the drilling of wells, a wellbore is formed using a drill bit that is urged downwardly at a lower end of a drill string. The wellbore extends from the earth's surface to a selected depth in order to intersect a desired material-bearing formation. In many drilling operations, the drill string comprises a plurality of "joints" of drill pipe that are connected together at the platform of the drilling rig. As the wellbore is formed at lower depths or more extended intervals, additional joints of pipe are added at the platform. These joints are then rotated and urged downwardly in order to form the wellbore. The drill method utilizes two sets of rotating tubulars. The top head turns the inner tubular (normally referred to as a drill pipe, drill rod, or drill steel), while the lower drive grips and turns the outer tubular (normally referred to as the casing). The drill rod is threaded onto the top head and has a bit on the bottom end (sections of drill pipe are threaded together making up the drill string). Pressurized drilling fluid (usually air or mud) is sent down the inside of the drill rod and cuttings are brought up on the outside of the drill rod, inside the casing. The casing is designed to stop the hole from collapsing and serves as the wellbore when completed. The casing is gripped and drilled (both rotated and pushed or pulled axially) into the ground. Movement (rotation and axial) is imparted to the casing using a lower drive that is constrained by a derrick and is capable of gripping the casing. Usually the casing is rotated in the opposite direction of the drill steel so that it does not apply an 'unthreading' torque to the drill rod. Sections of casing are usually welded together. As the casing penetrates into the earth and the wellbore is lengthened, more sections of hollow tubular casing are added. This involves stopping the drilling, i.e., rotational and axial translation of the drill pipe, while the successive tubulars are added. Current gripper designs are slow and cumbersome to use, adding unnecessary delay and cost to projects.

SUMMARY OF THE INVENTION

In accordance with the present disclosure, a rotary casing drill is provided to more efficiently rotate tubular pipe into a ground surface.

In illustrated embodiments, the rotary casing drill includes a grip assembly that is adapted to grip and rotate a tubular pipe of varying diameter. Grip assembly includes a grip housing that includes grippers that move radially inward to grip the tubular by use of a compression ring and a series of actuators.

In illustrative embodiments, grippers include a grip body and a grip adapter. Grip adapter can be exchanged out to accommodate different diameters of tubular pipe being used. Actuators are adapted to axially move a push-pull ring that, in turn, causes downward axial movement of the compression ring. Downward movement of the compression ring causes radial movement of grip bodies and grip adapters to allow grip adapters to quickly and efficiently grip the tubular pipe. Grip assembly also includes retraction springs that are adapted to bias the grip body and grip adapters radially outward when compression ring is retracted upward to release the pipe.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
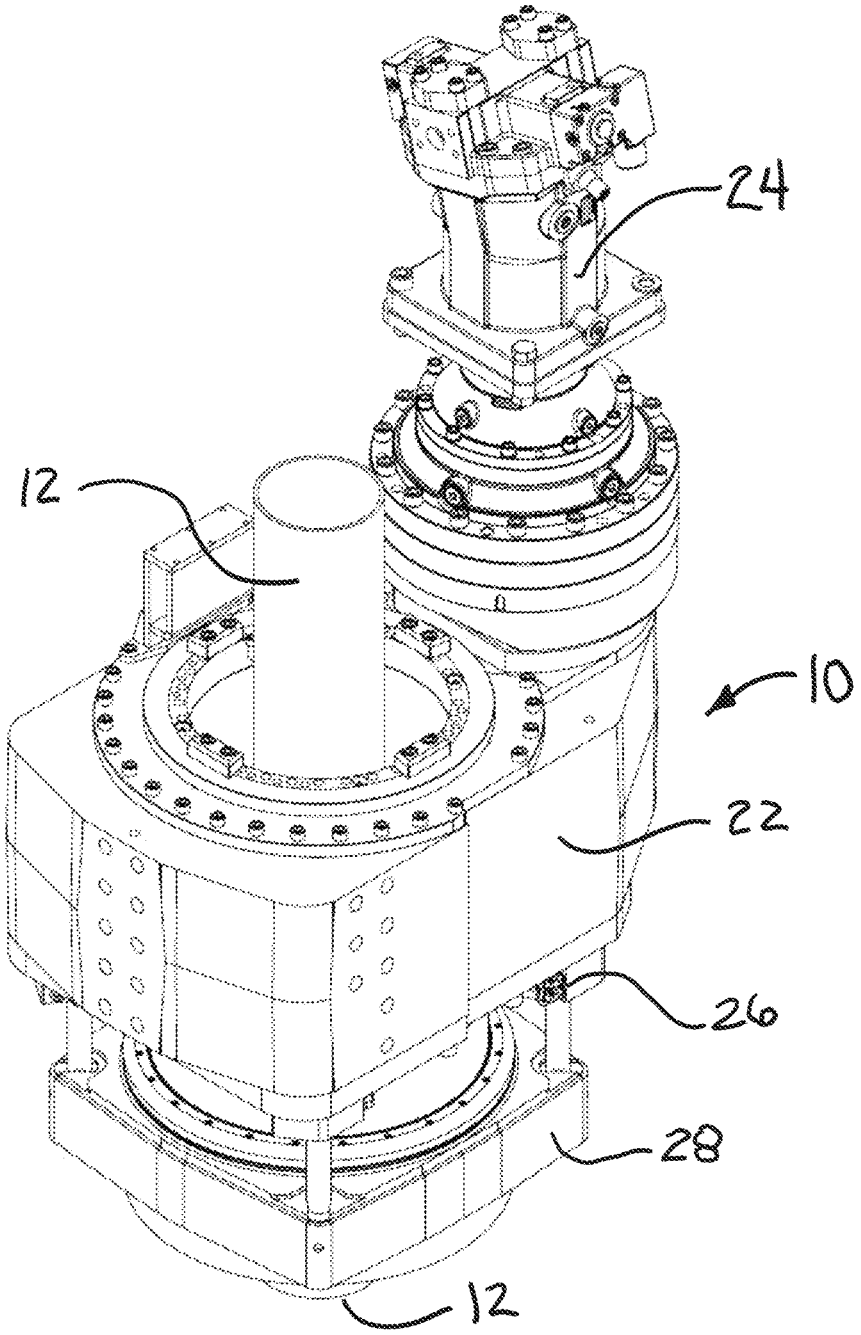
FIG. 1 is a perspective view of a rotary casing drill showing a tubular (i.e outer casing) positioned within the rotary casing drill in a vertical orientation.
Figure 2:
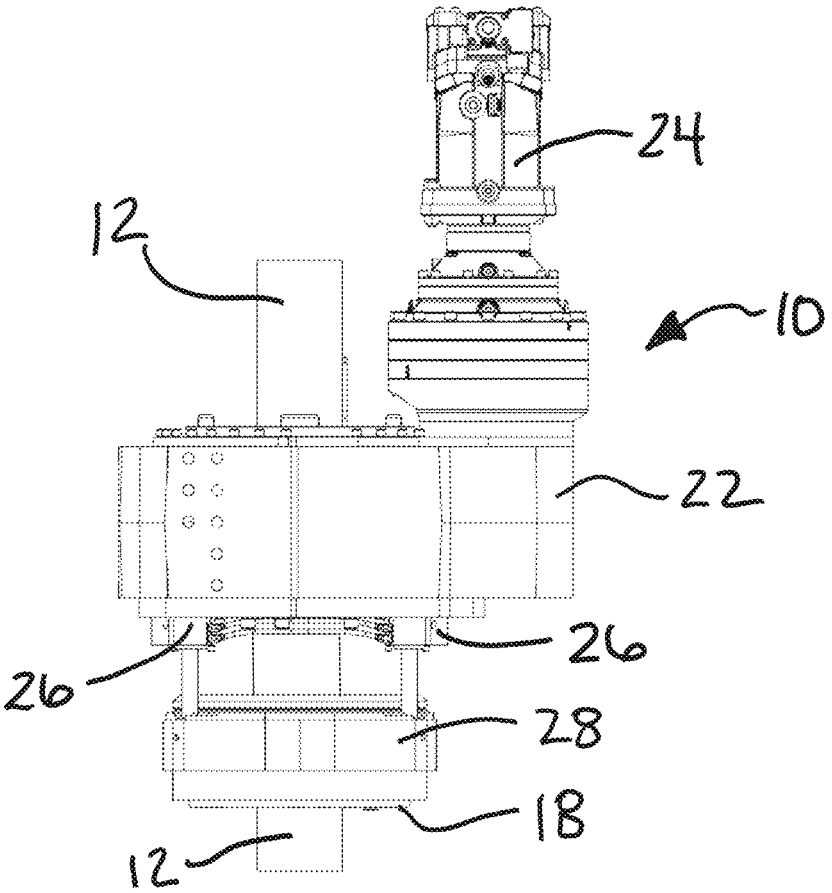
FIG. 2 is a side elevational view of the rotary casing drill of FIG. 1.

The present disclosure is directed to a rotary casing drill 10, as shown, for example, in FIG. 1, that is guided by a mast (not shown) attached the drill rig chassis (not shown). The mast constrains motion of the rotary drive in the longitudinal direction of the gripped tubular 12 and supports the rotational loads applied, an actuator (not shown) applies force to move the rotary casing drill 10 linearly, and a rotational motor within the rotary casing drill 10 applies rotational load to the output. The rotational load is supported by the mast while allowing for linear motion. The rotary casing drill 10 includes a housing 22, and a drive motor 24, coupled to the housing 22. Extending downward from housing 22 are four gripper hydraulic actuators 26 that are connected to push-pull ring 28, as shown in FIGS. 1 and 2.

Figure 3:
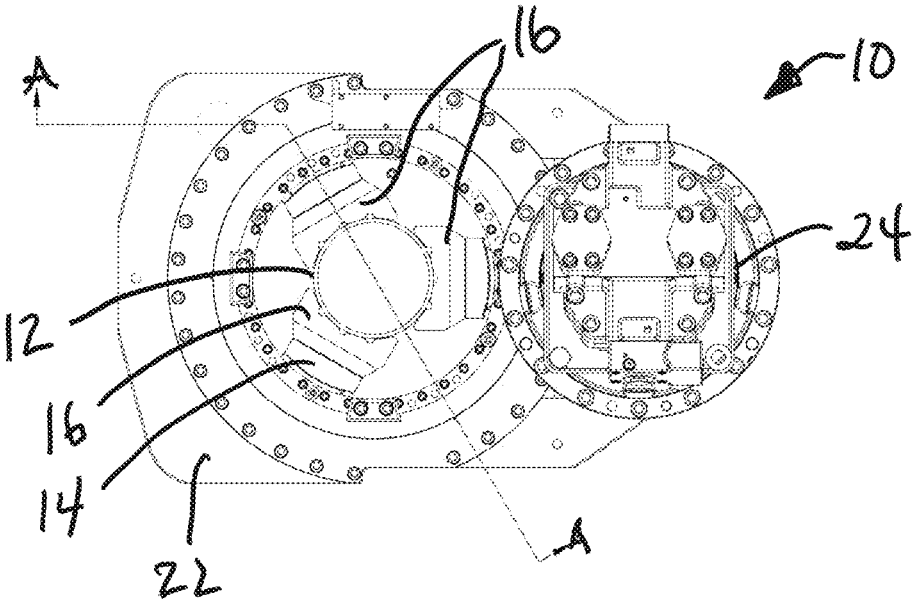
FIG. 3 is a top elevation view of the rotary casing drill showing three grippers surrounding the tubular.
Figure 4:
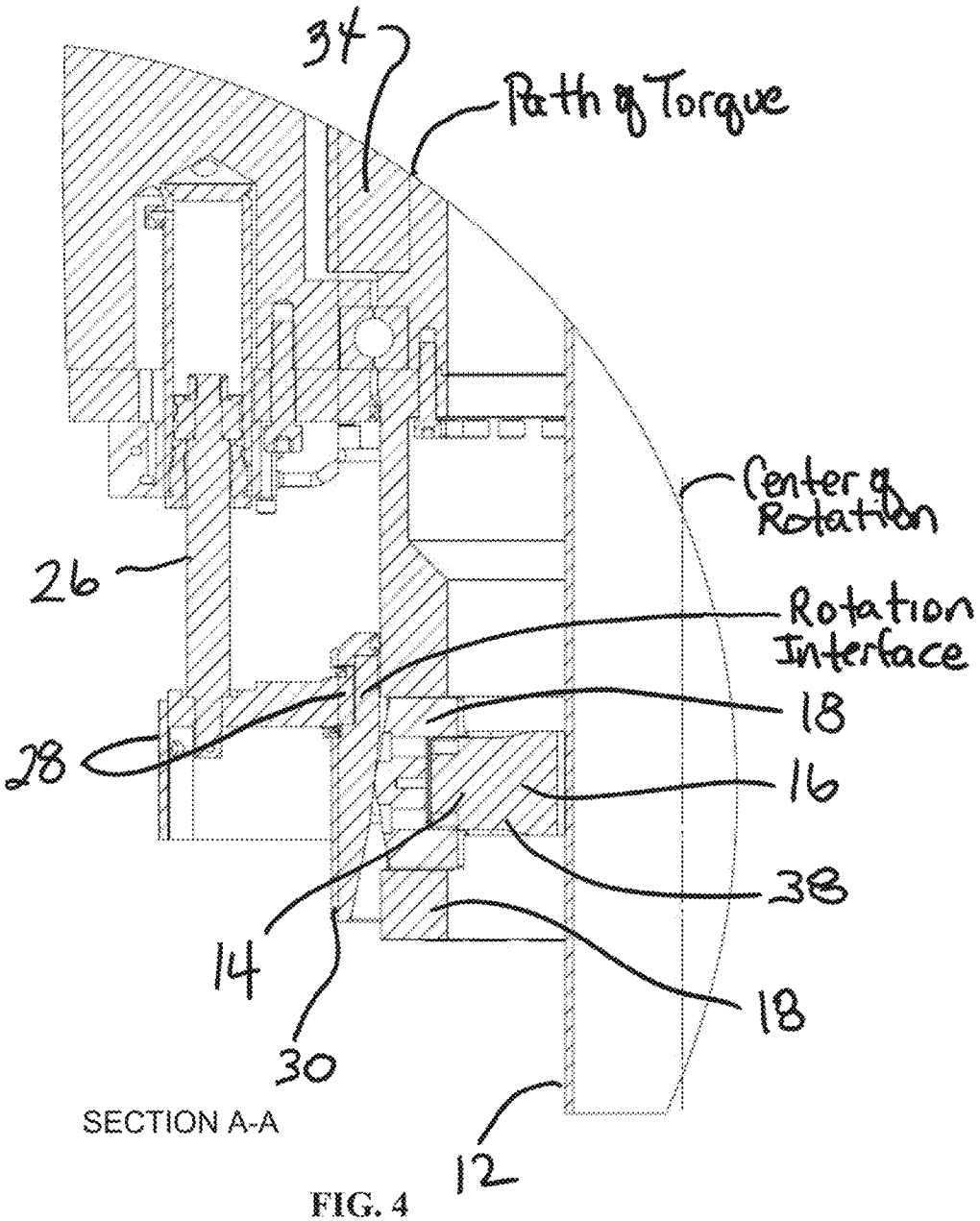
FIG. 4 is a sectional view of FIG. 3 taken along line A-A and showing the tubular, one of the grippers, a compression ring, a push-pull ring, and one of the hydraulic cylinders used to move the push-pull ring and compression ring in an axial direction.
Figure 6:
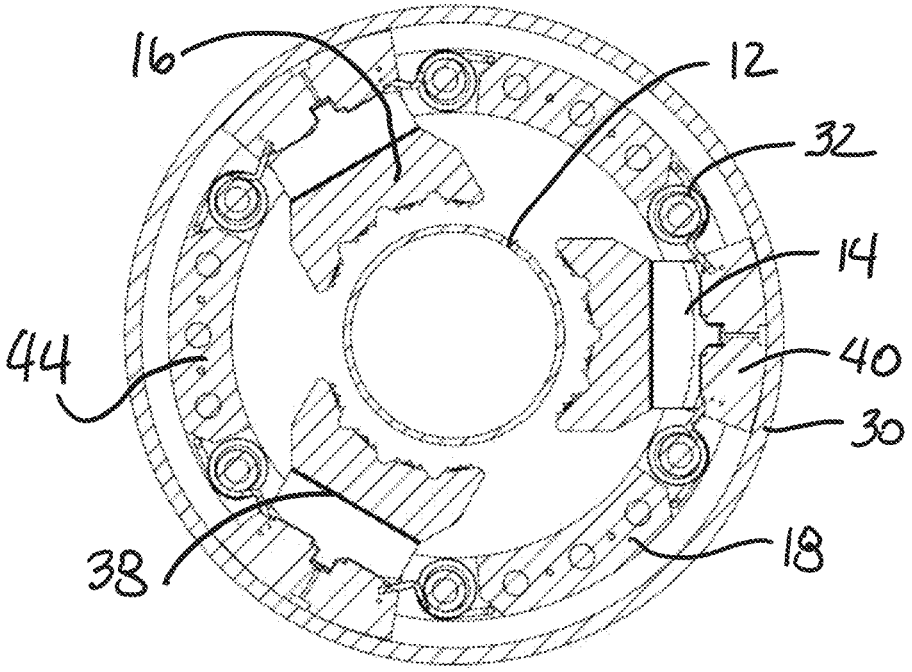
FIG. 6 is a sectional view of FIG. 2 taken along line C-C showing three grippers surrounding the tubular, the grippers are surrounded by a compression ring and are biased radially outwardly by retraction springs located on each side of the grippers.

The tubular 12 is gripped by a grip assembly 14, as shown, for example, in FIG. 3. The grip assembly 14 includes three grippers 16 that slide in a radial direction with respect to the tubular 12. The grippers 16 are constrained by a guide frame 18, as shown in FIGS. 2, 4, and 6. The grippers 16 include a face that conforms to the curvature of the tubular and may include teeth or gripper inserts that include teeth to grip the tubular. The guide frame 18 is connected to the rotating output from the rotary drive. The grip force between the grippers 16 to the tubular 12 is applied using a compression ring 30 that slides axially to assist in gripping the tubular 12. As compression ring 30 slides axially downward, it forces the grippers 16 radially inwardly toward the centerline of the tubular 12. Compression ring 30 and grippers 16 include caming surfaces that allow compression ring 30, upon downward axial movement to cam grippers 16 radially inwardly to grip the tubular 12. Retraction springs 32 between the frame 18 and grippers 16 allow the grippers 16 to maintain contact with the compression ring 30 and bias the grippers 16 radially outwardly when the compression ring 30 is moved axially upwardly away from the grippers 16.

The compression ring 30 is guided by the frame 18 so that it will only move longitudinally (axially) with respect to the tubular 12, and perpendicular to the sliding of the grippers 16. Force is applied to the compression ring by hydraulic actuators 26 connected to push-pull ring 28. The push-pull ring 28 and hydraulic actuators 26 do not rotate, while the compression ring 30, frame 18, and grippers 16 rotate with the output shaft of the rotary. The push-pull ring 28 applies a load to the compression ring 30, thus sliding the tapered inner surface of compression ring 30 over the grippers 16 and to apply a grip force to the tubular 12 by grippers 16.

When the actuation load on the push-pull ring 28 is released and friction between the compression ring 30 and the grippers 16 is such that it maintains grip on the tubular 12. This way the rotary drill can turn and push/pull the tubular 12 without any grip application force being maintained through the rotating joint. Stated another way, once the push-pull ring 28 moves the compression ring 30 axially downward to move the grippers 16 radially inward, the load being applied to the push-pull ring 28 by the actuators can be released and the compression ring 30 and grippers 16 will maintain the locked position on the tubular to allow the rotary casing drill 10 to continue to rotate the tubular 12 without a force being applied by the push-pull ring. This arrangement allows the compression ring 30 to float within the push-pull ring 28 so no unnecessary wear takes place between components and does not require rotary movement of the push-pull ring. When desired, a release load on from the push-pull ring 28 to the compression ring 30 can be applied to allow the retraction springs 32 to bias the grippers 16 radially outwardly away from the tubular 12 and release the tubular 12 so that the equipment can be repositioned along the tubular 12.

FIG. 4 illustrates a sectional view of FIG. 3 taken along line A-A. FIG. 4 illustrates one of the four hydraulic actuators 26 pushing the push-pull ring 28 and compression ring 30 axially downward to cause the grippers 16 to move radially inwardly to grip the tubular 12. The hydraulic actuators move into a float position (i.e. any upward and downward force is removed) so that the compression ring 30 can rotate freely with all components between it and the tubular 12, including the grippers 16, guide frame 18, and retraction springs 32. While hydraulic actuators are contemplated, any type of linear actuator could be used to move push-pull ring 28 in an axial direction, such as electric or mechanical.

Torque flows down from the spur gear 34, through the output shaft 36, and into the grip assembly 14, as shown in FIGS. 4 and 12. Grippers 16 of grip assembly 14 include grip adapter 38 and grip body 40, as shown in FIG. 6. Grip adapters 38 can be changed out to accommodate different diameters of tubular pipe and are contoured to fit the profile of the tubular 12. Grip adapters 38 are configured to engage tubular 12 and are coupled to grip body 40. Grip body 40 is adapted to be engaged by compression ring 30. Compression ring 30, during operation, moves axially downward to overcome biasing force of retraction springs 32 to move all three grip bodies 40 and grip adapters 38 radially inward to grip tubular 12.

Figure 5:
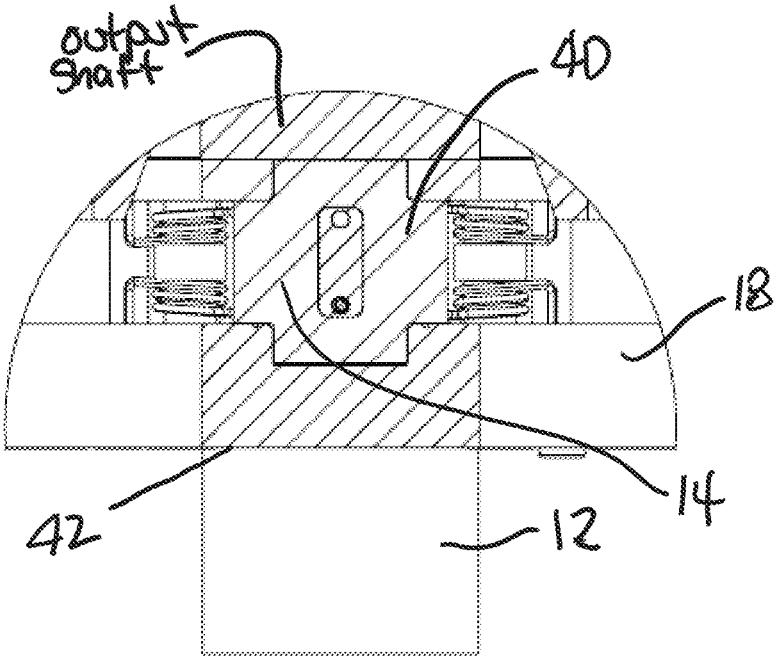
FIG. 5 is a sectional view of FIG. 2 taken along line B-B showing the guide frame engaging a portion of the grip assembly to transmit torque to the grip assembly.

FIG. 5 illustrates a sectional view of FIG. 2 taken along line B-B. Grip assembly 14, which includes grip bodies 40 and grip adapters 38 slide linearly with respect to the output shaft 36 when not under load. The grip adapters 38 may include grip inserts (not shown), which are custom components with teeth or other friction surface that are used for most sizes of pipe. The grip inserts are fitted into the grip adapters 38 and can be replaced if they become worn. The largest grip adapters have teeth cut directly into the grip adapters 38 in place of using the grip inserts. When drilling, torque is transmitted from the output shaft 36 to the grip assembly 14 through the surfaces shown. Guide frame 18 includes a notch 42 that accepts a grip body 40. Rotation of guide frame 18 causes the interaction between notch 42 and grip body 40 to rotate grip body. Notch 42 allows grip body 40 and grip adapters 38 to move radially. Retraction springs 32 bias grip body 40 to allow grip body 40 and grip adapters 38 to move radially outward when compression ring 30 is moved axially upward to release the grip adapters 38 from the tubular 12.

FIG. 6 illustrates a section view of FIG. 2 taken along line C-C. Retraction springs 32 bias the grip assembly 14 away from the tubular 12 (releasing grip) when the compression ring 30 is axially raised by the hydraulic actuators 26. FIG. 6 illustrates three grippers 16 positioned around the tubular pipe 12. Grippers 16 include grip adapters 38 that grip the tubular 12 and grip bodies 40 that are radially outward from grip adapters 38. Spaced between grippers 16 are grip spacers 44. It is preferred to have three grippers 16 spaced between three grip spacers 44. While three grippers 16 and grip spacers 44 are shown, it is possible to use two or more grippers 16 and grip spacers 44. Grip adapters 38 have a curved face that are configured to match the profile of the tubular 12 to allow grip. Retraction springs 32 are positioned on each side of the grip bodies 40 and are adapted to bias grip bodies 40 and grip adapters 38 radially outward when compression ring 30 is retracted. Retraction springs 32 are a torsion type spring that apply a biasing force on the grip bodies 40.

Figure 7:
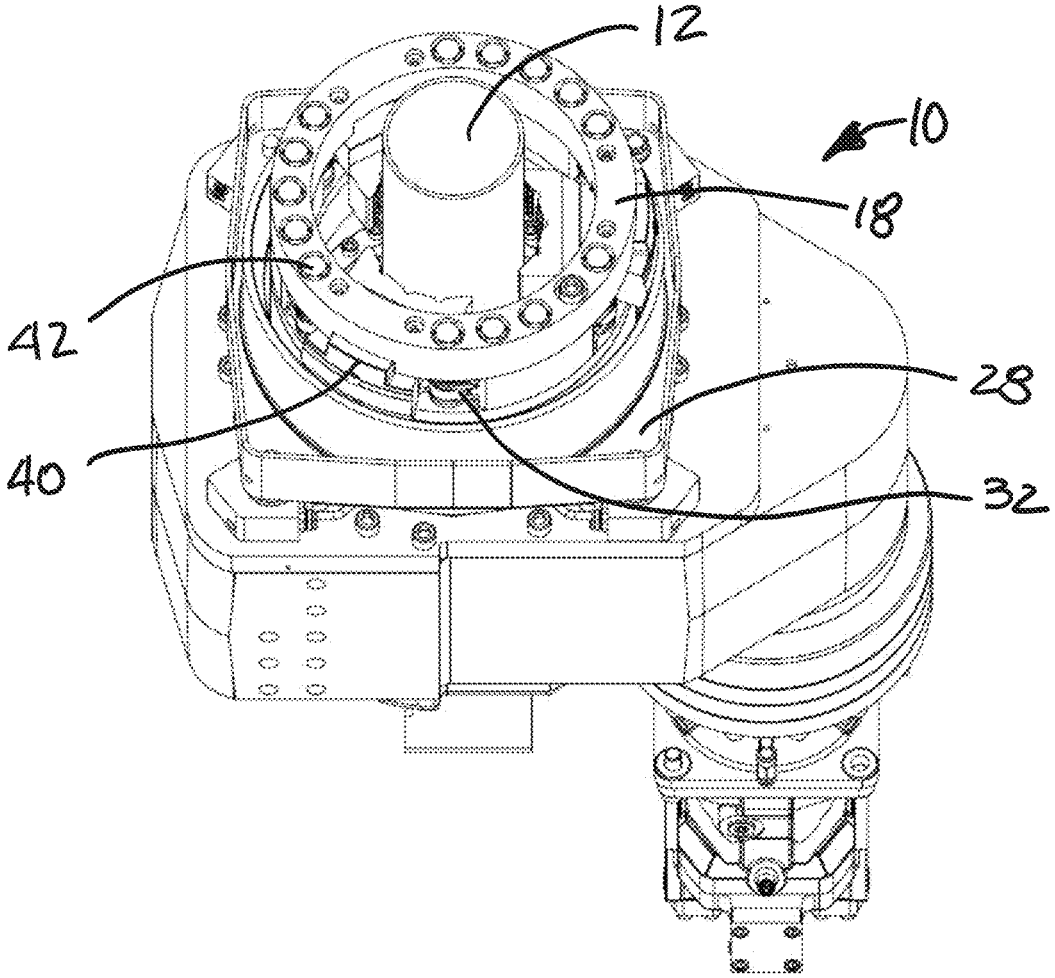
FIG. 7 is a perspective view of the grip assembly showing three grippers surrounding the tubular.

FIG. 7 is a perspective view of grip assembly 14 that includes guide frame 18 and three grip adapters 38 positioned around the tubular 12. Guide frame 18 is secured with a plurality of fasteners 46, which maintain the position of the grip adapters 38, grip bodies 40 and retraction springs 32. Spaced between grippers 16 are grip spacers 44. Retraction springs engage the rings above and below the grip spacers 44 at one end and to grip bodies 40 at a second end to bias grip bodies 40 and grip adapters 38 radially outward from the tubular 12.

Figure 8:
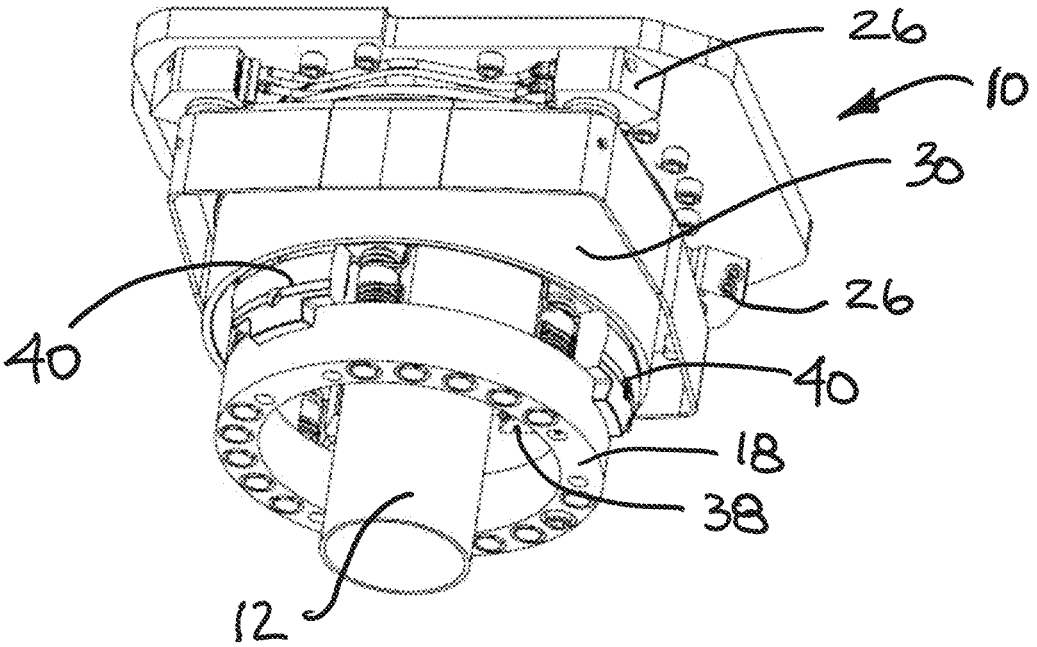
FIGS. 8 and 9 are perspective views of the rotary casing drill showing the push-pull ring and compression ring in their retracted release position in FIG. 8 and in the downward lock position in FIG. 9.
Figure 9:
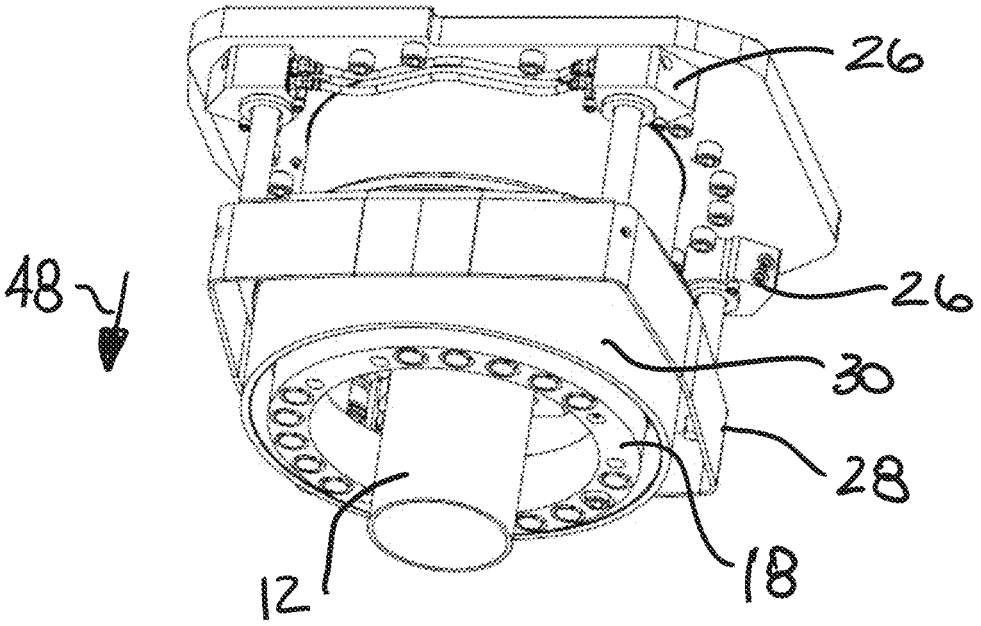

FIGS. 8 and 9 illustrate the actuation of hydraulic actuators 26 from a release position shown in FIG. 8 to a lock position shown in FIG. 9. To secure tubular 12, the four hydraulic actuators 26 are extended, which causes the push-pull ring 28 to move axially downward. Downward movement of the push-pull ring 28, as shown by arrow 48, causes downward axial movement of compression ring 30. Grip bodies 40 have a convex outer surface and compression ring 30 has a curved inner surface so that compression ring 30 cams grip bodies 40 axially inward on downward movement of compression ring 30. Once grip bodies 40 are in their inward position, hydraulic actuators 26 move into a float position (i.e. downward and upward force is removed) so that the compression ring 30 can rotate freely with all components of grip assembly 14 between it and the tubular 12. Torque flows down from the spur gear 34, through the output shaft 36, and into the grip assembly 14.

Figure 10:
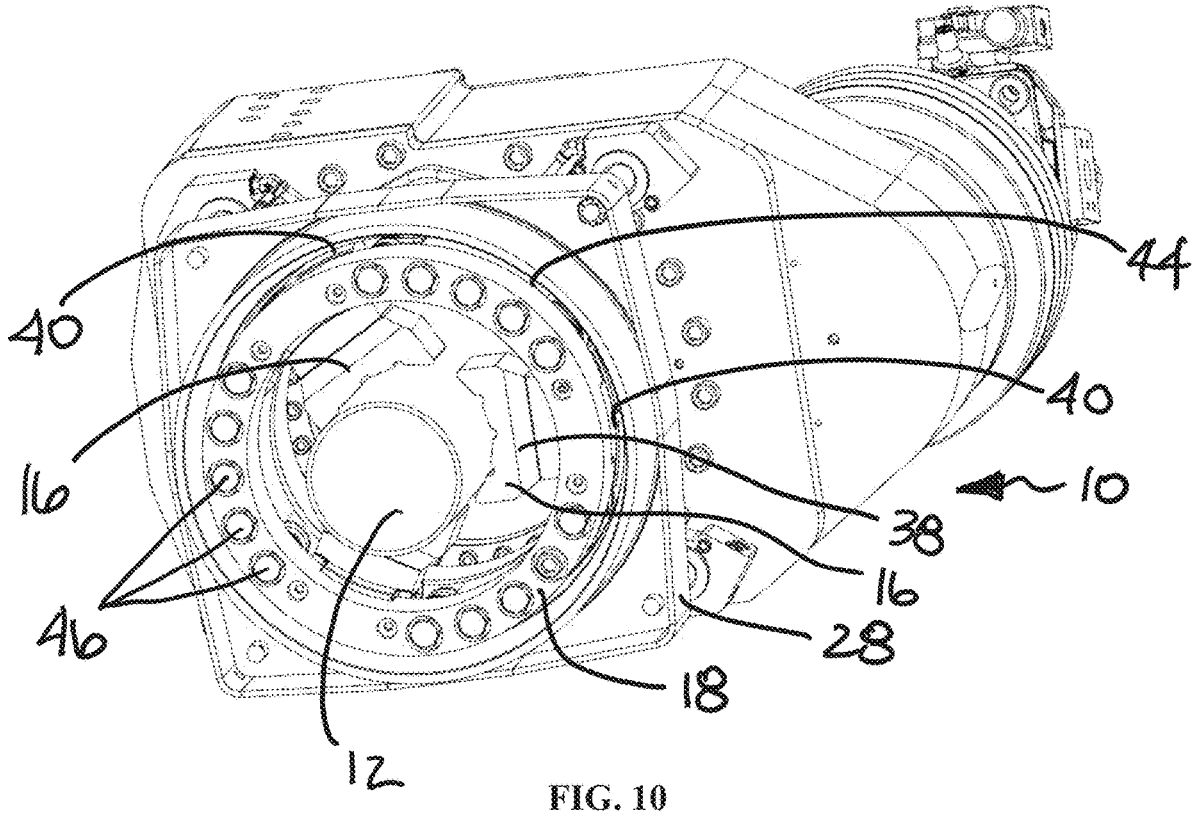
FIG. 10 is a perspective view of the grip assembly surrounding the tubular.
Figure 11:
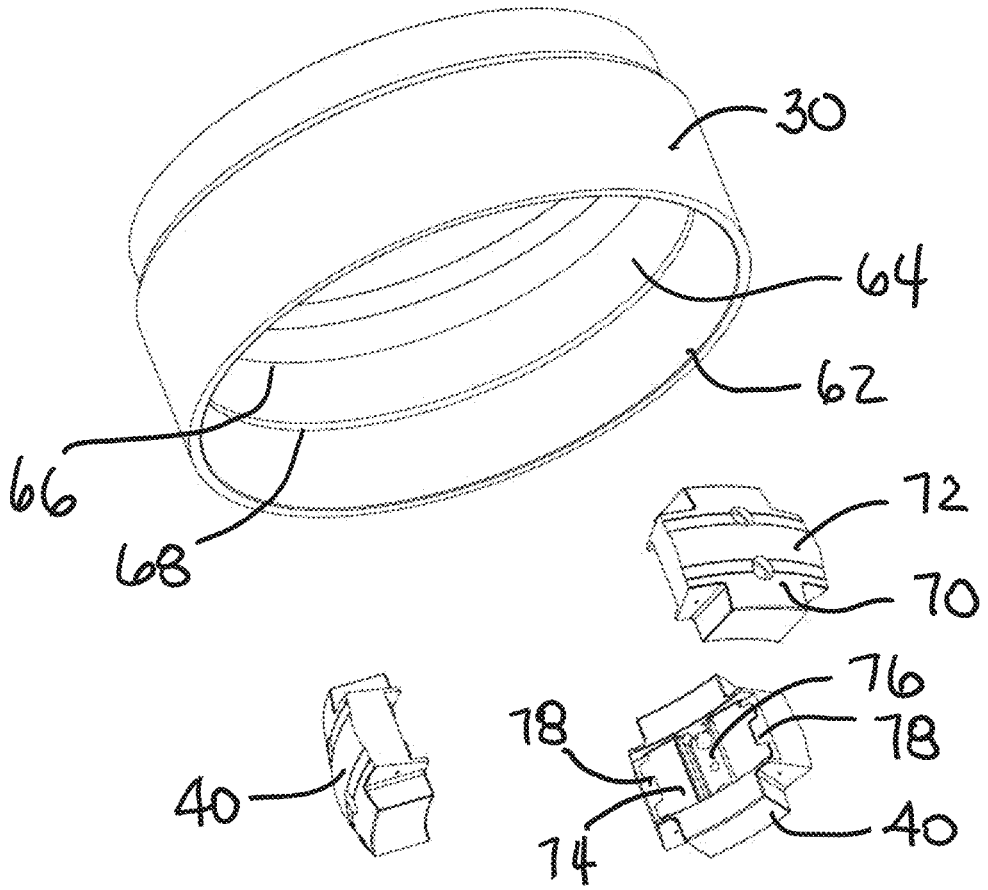
FIG. 11 is an exploded perspective view of the grip assembly showing the grippers and the compression ring.

FIG. 10 provides an additional perspective view of the grip assembly 14 of rotary casing drill 10. Frame 18 is shown beneath grippers 16 and secured by fasteners 46. Replaceable grip adapters 38 surround the tubular 12 and have a gripping face or gripping insert with teeth that is adapted to grip the tubular 12. Grip spacers 44 are shown positioned between grip bodies 40 and grip adapters 38. Retraction springs 32 are configured to be positioned around posts 50. There is a post 50 located on each side of grip bodies 40. Posts 50 have a raised center portion 52 that is of a greater diameter than the remaining portion of the posts 50 to maintain the position of the springs 32.

Compression ring 30 and grip bodies 40 are best shown in FIG. 14. Compression ring 30 is cylindrical in shape and includes a lower recess 62 formed on an inside surface 64 of compression ring 30. Compression ring 30 includes a raised center region 66 and a transition 68 between the lower recess 62 and center region 66. Grip bodies 40 include an outer surface 70 that is formed to include a raised rib 72. Raised ribs 72 of grip bodies 40 are adapted to engage the raised center region 66 of compression ring 30 when compression ring 30 is moved axially downward by hydraulic actuators 26. Grip bodies 40 include an inner surface 74 that includes a center slot 76 and outward tabs 78 that are adapted to engage with the grip adapters 38.

A rotary casing drill for gripping and rotating a tubular structure the rotary casing drill comprising a housing and a grip assembly for gripping the tubular structure, the grip assembly including a plurality of grippers that are configured to grip the tubular structure, the grippers are positioned radially outwardly from the tubular structure and are adapted to move in a radial direction toward and away from the tubular structure. The grip assembly also includes a guide frame that is configured to guide movement of the grippers and a compression ring that is positioned radially outwardly from the grippers and is configured to move in an axial direction from a first position to a second position, wherein axial movement of the compression ring causes radial movement of the grippers. The grip assembly also includes at least one biasing member that is configured to bias one or more of the grippers radially outwardly away from the tubular structure when the compression ring is moved axially away from the grippers. The tubular structure, guide frame, grippers, and compression ring are configured to rotate together about an axis of rotation.

The rotary casing drill further includes a push-pull structure that is positioned radially outwardly of the compression ring, the push-pull structure is configured to move the compression ring in an axial direction upon movement of the push-pull structure. The push-pull structure does not rotate with the tubular structure, guide frame, grippers, or compression ring. The drill also includes at least one actuator configured to cause axial movement of the push-pull structure.

The compression ring and grippers include surfaces that allow compression ring, upon downward axial movement, to cam grippers radially inwardly to grip the tubular. After the push-pull structure moves the compression ring axially downward to move the grippers radially, the load on the push-pull structure is released and the compression ring and grippers will maintain a locked position on the tubular structure to allow the rotary casing drill to continue to rotate the tubular without an application of force by the push-pull structure. The actuator of the rotary casing drill is hydraulic and at least one biasing member is in the form of springs positioned between the grippers and portions of the guide frame to bias the grippers away from the tubular structure. The grippers include a convex outer surface and compression ring includes a curved inner surface so that compression ring cams grippers axially inward during downward movement of compression ring.

The rotary casing drill is designed for gripping and rotating a tubular structure and includes a housing for housing at least a portion of a drive mechanism, a grip assembly driven by the drive mechanism, the grip assembly configured to grip the tubular structure. The grip assembly including a plurality of grippers that are configured to grip the tubular structure. The grippers are positioned radially outwardly from the tubular structure and are adapted to move in a radial direction toward and away from the tubular structure. The grip assembly also includes a guide member that is configured to guide movement of the grippers and a compression ring that is positioned radially outwardly from the grippers and is configured to move in an axial direction from a first position to a second position, wherein axial movement of the compression ring causes radial movement of the grippers.

The grip assembly also includes a push-pull member configured to axially move the compression ring and a linear actuator that is configured to move the push pull member in an axial direction. The grip assembly further includes at least one biasing member that is configured to bias one or more of the grippers radially outwardly away from the tubular structure when the compression ring is moved axially away from the grippers by the push-pull member. The drill is designed so that the tubular structure, guide member, grippers, biasing member, and compression ring rotate together about an axis of rotation.

The push-pull member and linear actuator do not rotate with the tubular structure, guide member, grippers, biasing member, and compression ring. The compression ring and grippers include surfaces that allow compression ring, upon downward axial movement, to cam grippers radially inwardly to grip the tubular. After the push-pull structure moves the compression ring axially downward to move the grippers radially, the load on the push-pull structure is released and the compression ring and grippers will maintain a locked position on the tubular structure to allow the rotary casing drill to continue to rotate the tubular without an application of force by the push-pull structure. The actuator of the drill is hydraulic and the at least one biasing member is in the form of springs positioned between the grippers and portions of the guide member to bias the grippers away from the tubular structure. The grippers include a convex outer surface and the compression ring includes a curved inner surface so that compression ring cams grippers axially inward during downward movement of compression ring. The push-pull member is permitted to float about the compression ring when the compression ring is in the second position. The linear actuator positions the push-pull member into a float position about the compression ring.

The rotary casing drill for gripping and rotating a tubular structure that includes a housing, at least one gear positioned within the housing and a grip assembly driven by the gear. The grip assembly is configured to grip the tubular structure and includes a plurality of grippers that are configured to grip the tubular structure. The grippers are positioned radially outwardly from the tubular structure and are adapted to move in a radial direction toward and away from the tubular structure. The grip assembly also includes a compression ring that is positioned radially outwardly from the grippers and is configured to move in an axial direction from a first position to a second position, wherein axial movement of the compression ring causes radial movement of the grippers. The grip assembly also includes a push-pull member configured to axially move the compression ring and at least one biasing member that is configured to bias one or more of the grippers radially outwardly away from the tubular structure when the compression ring is moved axially away from the grippers by the push-pull member. The compression ring is in the second position, the push-pull member is permitted to float with respect to the compressing ring. The drill also includes a linear actuator that is configured to move the push pull member in an axial direction.

Various features of the invention have been particularly shown and described in connection with the illustrative embodiment of the invention, however, it must be understood that these particular arrangements may merely illustrate, and that the invention is to be given its fullest interpretation within the terms of the appended claims.

What is claimed is:

1. A rotary casing drill for gripping and rotating a tubular structure the rotary casing drill comprising:

a housing;

a grip assembly for gripping the tubular structure, the grip assembly including a plurality of grippers that are configured to grip the tubular structure, the grippers are positioned radially outwardly from the tubular structure and are adapted to move in a radial direction toward and away from the tubular structure;

a guide frame that is configured to guide movement of the grippers;

a compression ring that is positioned radially outwardly from the grippers and is configured to move in an axial direction from a first position to a second position, wherein axial movement of the compression ring causes radial movement of the grippers;

at least one biasing member that is configured to bias one or more of the grippers radially outwardly away from the tubular structure when the compression ring is moved axially away from the grippers; and wherein the tubular structure, guide frame, grippers, and compression ring are configured to rotate together about an axis of rotation.

2. The rotary casing drill of claim 1, further comprising a push-pull structure that is positioned radially outwardly of the compression ring, the push-pull structure is configured to move the compression ring in an axial direction upon movement of the push-pull structure.

3. The rotary casing drill of claim 2, wherein the push-pull structure does not rotate with the tubular structure, guide frame, grippers, or compression ring.

4. The rotary casing drill of claim 2, further comprising at least one actuator configured to cause axial movement of the push-pull structure.

5. The rotary casing drill of claim 1, wherein the compression ring and grippers include surfaces that allow compression ring, upon downward axial movement, to cam grippers radially inwardly to grip the tubular.

6. The rotary casing drill of claim 3 wherein after the push-pull structure moves the compression ring axially downward to move the grippers radially, the load on the push-pull structure is released and the compression ring and grippers will maintain a locked position on the tubular structure to allow the rotary casing drill to continue to rotate the tubular without an application of force by the push-pull structure.

7. The rotary casing drill of claim 4, wherein the actuator is hydraulic.

8. The rotary casing drill of claim 1, wherein the at least one biasing member is in the form of springs positioned between the grippers and portions of the guide frame to bias the grippers away from the tubular structure.

9. The rotary casing drill of claim 1, wherein grippers include a convex outer surface and the compression ring includes a curved inner surface so that the compression ring cams grippers axially inward during downward movement of compression ring.

10. A rotary casing drill for gripping and rotating a tubular structure the rotary casing drill comprising:

a housing for housing at least a portion of a drive mechanism;

a grip assembly driven by the drive mechanism, the grip assembly configured to grip the tubular structure, the grip assembly including a plurality of grippers that are configured to grip the tubular structure, the grippers are positioned radially outwardly from the tubular structure and are adapted to move in a radial direction toward and away from the tubular structure;

a guide member that is configured to guide movement of the grippers;

a compression ring that is positioned radially outwardly from the grippers and is configured to move in an axial direction from a first position to a second position, wherein axial movement of the compression ring causes radial movement of the grippers;

a push-pull member configured to axially move the compression ring;

a linear actuator that is configured to move the push pull member in an axial direction;

at least one biasing member that is configured to bias one or more of the grippers radially outwardly away from the tubular structure when the compression ring is moved axially away from the grippers by the push-pull member; and wherein the tubular structure, guide member, grippers, biasing member, and compression ring are configured to rotate together about an axis of rotation.

11. The rotary casing drill of claim 10, wherein the push-pull member and linear actuator do not rotate with the tubular structure, guide member, grippers, biasing member, and compression ring.

12. The rotary casing drill of claim 10, wherein the compression ring and grippers include surfaces that allow compression ring, upon downward axial movement, to cam grippers radially inwardly to grip the tubular.

13. The rotary casing drill of claim 12 wherein after the push-pull structure moves the compression ring axially downward to move the grippers radially, the load on the push-pull structure is released and the compression ring and grippers will maintain a locked position on the tubular structure to allow the rotary casing drill to continue to rotate the tubular without an application of force by the push-pull structure.

14. The rotary casing drill of claim 13, wherein the actuator is hydraulic.

15. The rotary casing drill of claim 10, wherein the at least one biasing member is in the form of springs positioned between the grippers and portions of the guide member to bias the grippers away from the tubular structure.

16. The rotary casing drill of claim 10, wherein grippers include a convex outer surface and the compression ring includes a curved inner surface so that the compression ring cams grippers axially inward during downward movement of the compression ring.

17. The rotary casing drill of claim 10, wherein the push-pull member is permitted to float about the compression ring when the compression ring is in the second position.

18. The rotary casing drill of claim 10, wherein the linear actuator positions the push-pull member into a float position about the compression ring.

19. A rotary casing drill for gripping and rotating a tubular structure the rotary casing drill comprising:

a housing;

at least one gear positioned within the housing;

a grip assembly driven by the gear, the grip assembly configured to grip the tubular structure, the grip assembly including a plurality of grippers that are configured to grip the tubular structure, the grippers are positioned radially outwardly from the tubular structure and are adapted to move in a radial direction toward and away from the tubular structure;

a compression ring that is positioned radially outwardly from the grippers and is configured to move in an axial direction from a first position to a second position, wherein axial movement of the compression ring causes radial movement of the grippers;

a push-pull member configured to axially move the compression ring;

at least one biasing member that is configured to bias one or more of the grippers radially outwardly away from the tubular structure when the compression ring is moved axially away from the grippers by the push-pull member; and wherein when the compression ring is in the second position, the push-pull member is permitted to float with respect to the compressing ring.

20. The rotary casing drill of claim 19, further including a linear actuator that is configured to move the push pull member in an axial direction.

* * * * *